US011193451B2

(12) United States Patent
Chen et al.

(10) Patent No.: US 11,193,451 B2
(45) Date of Patent: Dec. 7, 2021

(54) GAS IDLING TRANSITION PASSAGE STRUCTURE FOR OIL AND GAS DUAL-PURPOSE CARBURETOR

(71) Applicant: Qi'an Chen, Ruian (CN)

(72) Inventors: Qi'an Chen, Ruian (CN); Xingyao Zhang, Chongqing (CN)

(73) Assignee: Qi'an Chen

( * ) Notice: Subject to any disclaimer, the term of this patent is extended or adjusted under 35 U.S.C. 154(b) by 0 days.

(21) Appl. No.: 17/070,957

(22) Filed: Oct. 15, 2020

(65) Prior Publication Data

US 2021/0025353 A1 Jan. 28, 2021

(30) Foreign Application Priority Data

Oct. 16, 2019 (CN) ..... 201921728544.4

(51) Int. Cl.
*F02M 1/02* (2006.01)
*F02M 9/12* (2006.01)

(52) U.S. Cl.
CPC ..... *F02M 1/02* (2013.01); *F02M 9/12* (2013.01)

(58) Field of Classification Search
CPC ..... F02M 1/02; F02M 9/12
See application file for complete search history.

(56) References Cited

U.S. PATENT DOCUMENTS 5,638,803 A * 6/1997 Chang ..... F02M 37/0023 123/676
6,047,956 A * 4/2000 Brazina ..... F02M 19/03 261/78.1
8,579,265 B1 * 11/2013 Chen ..... F02M 1/02 261/34.1
2005/0045138 A1 * 3/2005 Schmidt ..... F02M 35/10118 123/184.46
2012/0247442 A1 * 10/2012 Mavinahally ..... F02M 13/08 123/73 PP
2015/0322895 A1 * 11/2015 Mavinahally ..... F02M 21/042 123/527
2016/0363099 A1 * 12/2016 Collie ..... F02M 21/0212

* cited by examiner

*Primary Examiner* — George C Jin

(57) ABSTRACT

The utility model provides a gas idling transition passage structure for oil and gas dual-purpose carburetor, comprising a carburetor body 1 and a mixing chamber 4; a choke valve 5 and a throttle valve 9 are disposed in the mixing chamber 4 in the order of the air flow direction; a gas intake pipe 2 for supplying gas to the mixing chamber 4 is disposed on the carburetor body 1; a first air inlet pipe 7 and a second air inlet pipe 8 are disposed in the carburetor body 1 in parallel; an opening of an outlet end of the second air inlet pipe 8 is located in the mixing chamber 4 and the position of the outlet end of the second air inlet pipe 8 is at the intersection of an outer circle and the mixing chamber 4 when the throttle valve 9 is closed.

2 Claims, 4 Drawing Sheets

GAS IDLING TRANSITION PASSAGE STRUCTURE FOR OIL AND GAS DUAL-PURPOSE CARBURETOR

TECHNICAL FIELD

The present invention relates to the technical field of carburetor, in particular to a gas idling transition passage structure for oil and gas dual-purpose carburetor.

BACKGROUND OF THE INVENTION

Existing naturally aspirated engines usually use carburetor as the fuel supply system. Nowadays, the widely used dual-fuel engines, usually use gasoline or natural gas and liquefied petroleum gas as fuel. In the prior art, oil and gas dual-use carburetor The gas of the engine is mixed with air in front of the throttle in the mixing chamber to form a mixed gas and supplied to the engine. Due to the low volatilization pressure of the gas, when the engine needs to run at idle speed, the low engine speed causes the gas intake pipe to change The suction vacuum at the outlet end of the oil supply is low, and there is often insufficient gas in, the carburetor, which leads to insufficient fuel mixing ratio in the mixed gas, which makes the engine idling speed unstable with poor transition, and easy to stall; in order to ensure engine performance in normal operation, you can only increase the idle speed and increase the air intake. This method makes energy wasted.

BRIEF SUMMARY OF THE INVENTION

The purpose of the utility model, is to provide a gas idling transition passage structure for oil and gas dual-purpose carburetor, which can stably provide the gas required for engine idling and transitional conditions, and has the advantages of ensuring stable engine idling and transitional conditions which can solve the problem in the prior art is solved.

To achieve above goal, the present utility model provides a gas idling transition passage structure for oil and gas dual-purpose carburetor, comprising a carburetor body 1 and a mixing chamber 4; a choke valve 5 and a throttle valve 9 are disposed in the mixing chamber 4 in the order of the air flow direction; a gas intake pipe 2 for supplying gas to the mixing chamber 4 is disposed on the carburetor body 1; a first air inlet pipe 7 and a second air inlet pipe 8 are disposed in the carburetor body 1 in parallel; an opening of an outlet end of the second air inlet pipe 8 is located in the mixing chamber 4 and the position of the outlet end of the second air inlet pipe 8 is at the intersection of an outer circle and the mixing chamber 4 when the throttle valve 9 is closed; an outlet opening of the first air inlet pipe 7 is located in front of the second air inlet pipe 8 in the mixing chamber 4; the first air inlet pipe 7 and the second air inlet pipe 8 are communicated with the gas intake pipe 2 through a bypass passage 3.

Further, a distribution chamber 6 is disposed between the bypass passage 3 and the first air inlet pipe 7 and the second air inlet pipe 8.

The beneficial effects of the utility model: the utility model provides a gas idling transition passage structure for oil and gas dual-purpose carburetor. When the engine is working in idling speed and transitional conditions, sufficient gas is supplied to the mixing chamber through the first air inlet pipe and the second air inlet pipe disposed in parallel and mixed with air to provide to the engine to ensure the stable operation of the engine during idling and transitional conditions; the opening of the outlet end of the second intake pipe is disposed in the mixing chamber and the position of the outlet end of the second air inlet pipe is at the intersection of the outer circle and the mixing chamber when the throttle valve is closed, when the throttle valve is opened to the idle state, the gas supply is able to be sensitively controlled to improve the controllability of the engine; when the throttle valve continues to open and air goes cross the first air inlet pipe, the first air inlet pipe and the second air inlet pipe supply enough gas to the mixing chamber at the same time, so as to ensure the fuel gas demand of the engine in the transient condition and improve the stability of the engine; through the distribution chamber, the gas is able to be better supplied to the first inlet pipe and the second air inlet pipe; meanwhile, the manufacturing process of the first air inlet pipe and the second air inlet pipe is simple, and the machining accuracy of the two pipes is easier to be guaranteed.

DETAILED DESCRIPTION OF THE INVENTION

Figure 1:
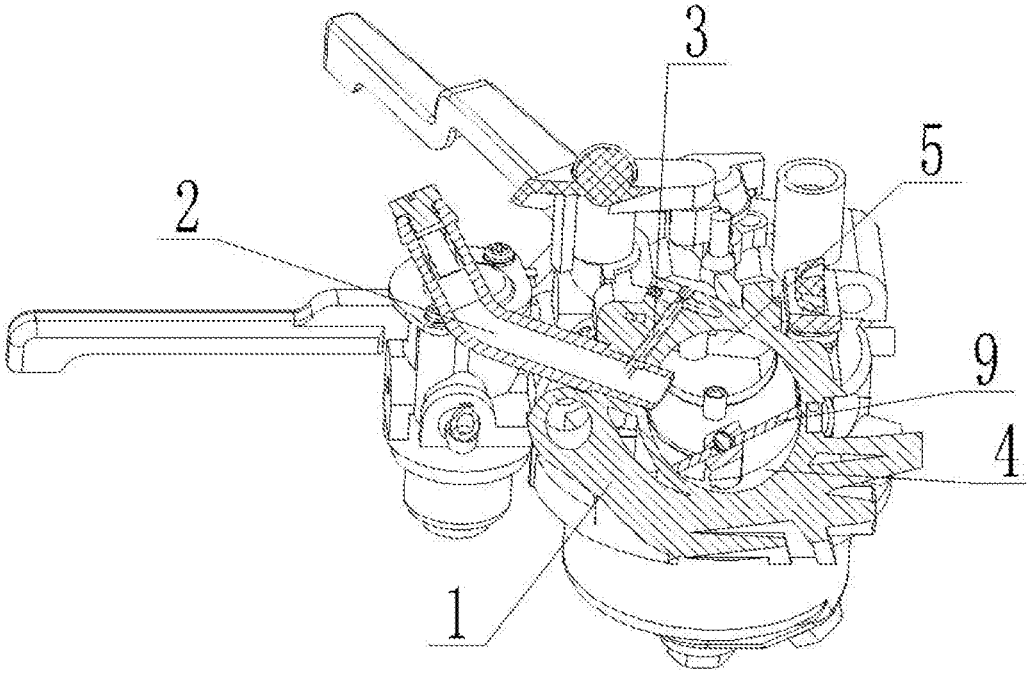
FIG. 1 is a Schematic diagram of the utility model.

Referring to FIGS. 1-4, a gas idling transition passage structure for oil and gas dual-purpose carburetor comprises a carburetor body 1 and a mixing chamber 4; a choke valve 5 and a throttle valve 9 are disposed in the mixing chamber 4 in the order of the air flow direction; a gas intake pipe 2 for supplying gas to the mixing chamber 4 is disposed on the carburetor body 1; a first air inlet pipe 7 and a second air inlet pipe 8 are disposed in the carburetor body 1 in parallel; an opening of an outlet end of the second air inlet pipe 8 is located in the mixing chamber 4 and the position of the outlet end of the second air inlet pipe 8 is at the intersection of an outer circle and the mixing chamber 4 when the throttle valve 9 is closed; an outlet opening of the first air inlet pipe 7 is located in front of the second air inlet pipe 8 in the mixing chamber 4; the first air inlet pipe 7 and the second air inlet pipe 8 are communicated with the gas intake pipe 2 through a bypass passage 3.

Preferably, a distribution chamber 6 is disposed between the bypass passage 3 and the first air inlet pipe 7 and the second air inlet pipe 8.

Figure 2:
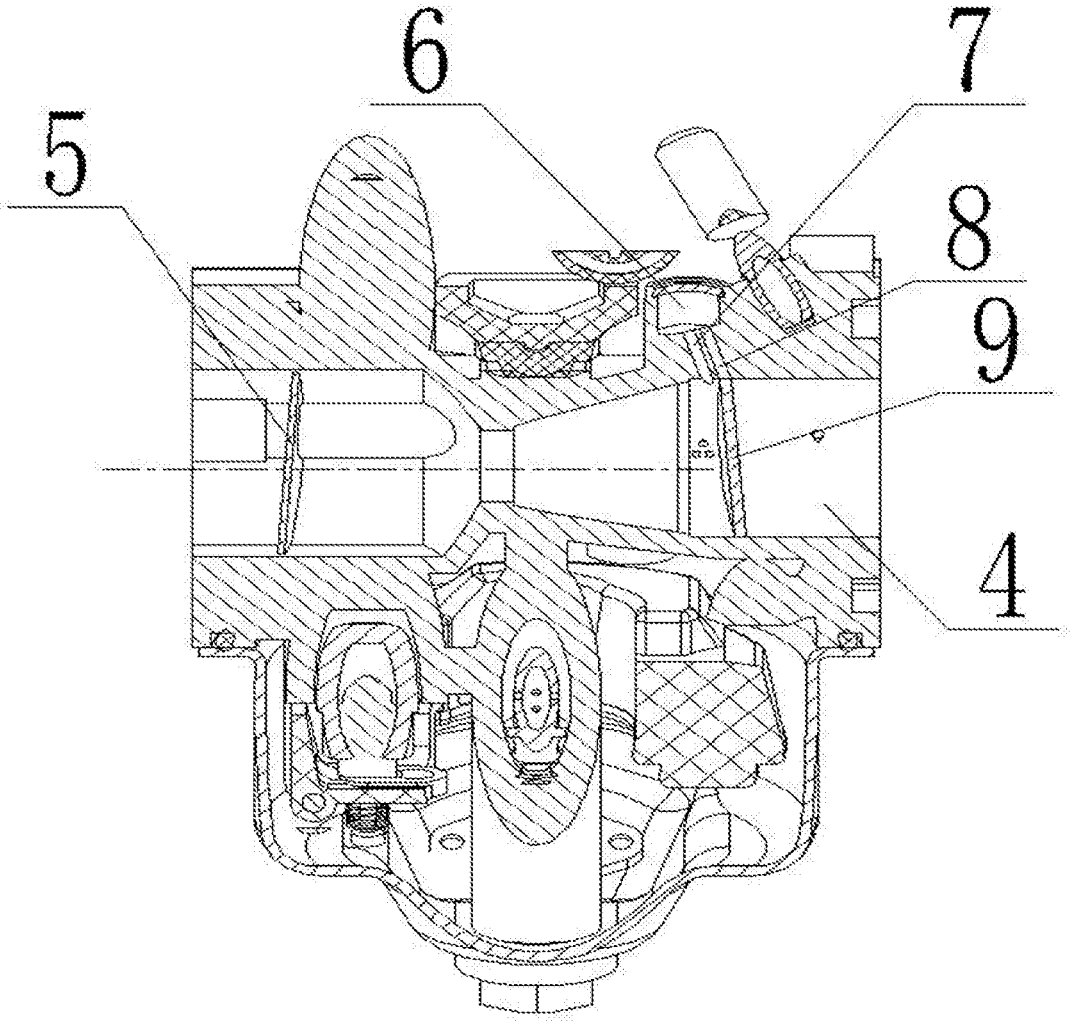
FIG. 2 is a is a schematic diagram of the structure of the utility model when the throttle valve is fully closed.
Figure 3:
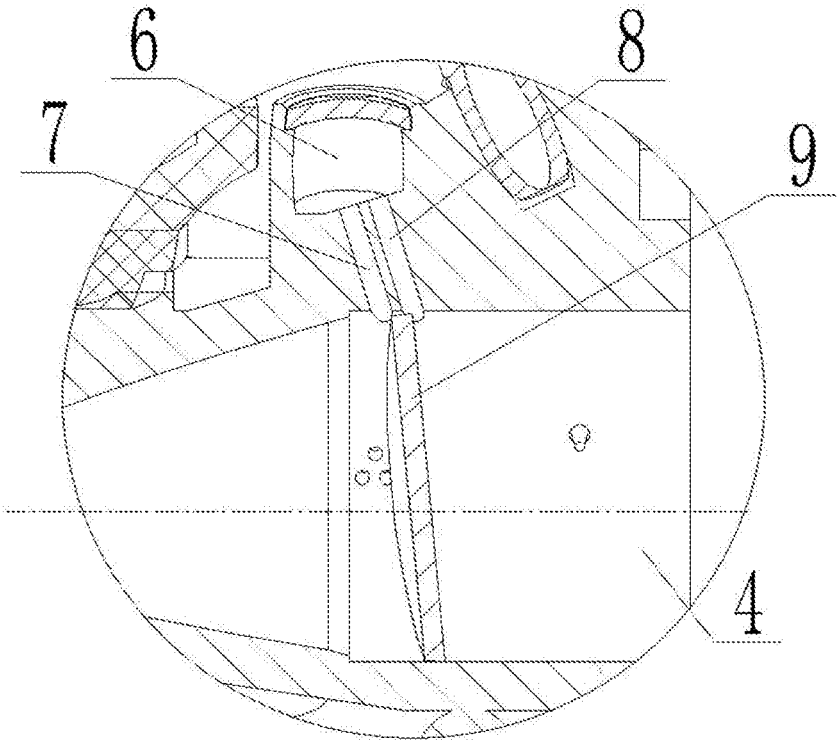
FIG. 3 is a schematic diagram of the structure of the utility model when the throttle valve is in an idling state.
Figure 4:
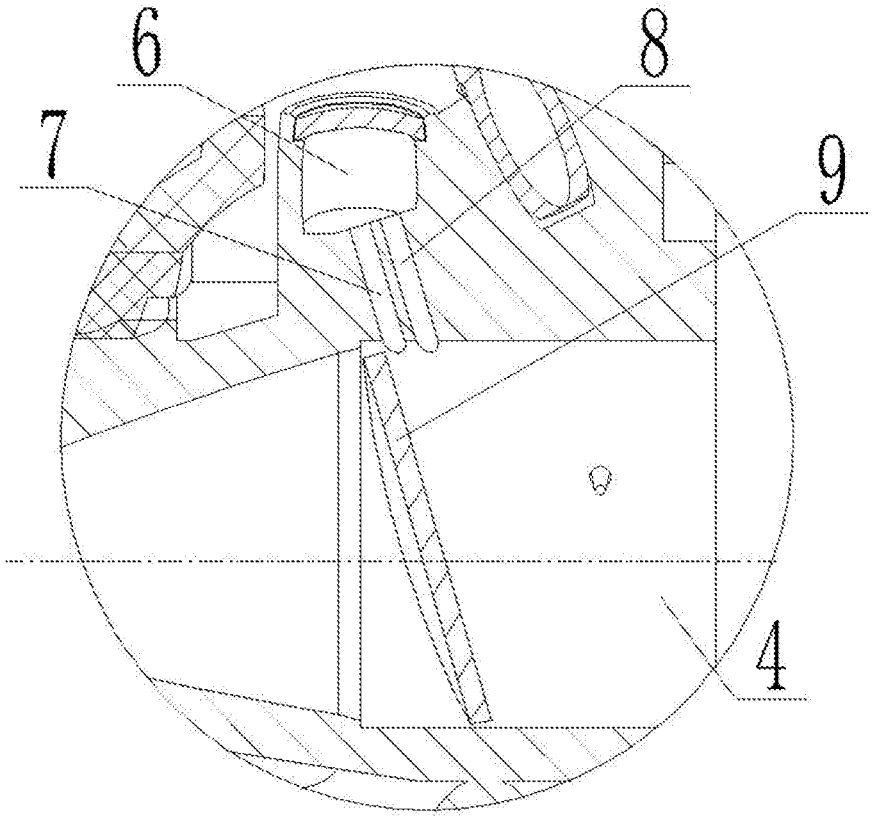
FIG. 4 is a schematic diagram of the structure of the utility model when the throttle valve is in the idle to high-speed transition state.

The utility model provides a gas idling transition passage structure for oil and gas dual-purpose carburetor. When the engine is working in idling speed and transitional conditions, sufficient gas is supplied to the mixing chamber 4 through the first air inlet pipe 7 and the second air inlet pipe 8 disposed in parallel and mixed with air to provide to the engine to ensure the stable operation of the engine during idling and transitional conditions;

as an embodiment and showed in FIG. 2, the opening of the outlet end of the second intake pipe 8 is, disposed in the mixing chamber 4 and the position of the outlet end of the second air inlet pipe 8 is at the intersection of the outer circle and the mixing chamber 4 when the throttle valve 9 is closed;

as an embodiment and showed in FIG. 3, when the throttle valve 9 is opened to the idle state, the air outlet opening of the second air inlet pipe 8 is communicated with the mixing chamber 4 to supply gas into the mixing chamber 4, which has high sensitivity and improves the controllability of the engine;

as an embodiment and showed in FIG. 4, when the throttle valve 9 continues to open and air goes cross the first air inlet pipe 7, the first air inlet pipe 7 and the second air inlet pipe 8 supply enough gas to the mixing chamber 4 at the same time, so as to ensure the fuel gas demand of the engine in the transient condition and improve the stability of the engine; through the distribution chamber 6, the gas is able to be better supplied to the first inlet pipe 7 and the second air inlet pipe 8; meanwhile, the manufacturing process of the first inlet pipe 7 and the second air inlet pipe 8 is simple, and the machining accuracy of the two pipes is easier to be guaranteed.

It should be noted that in this article, relational terms such as first and second are only used to distinguish one entity or operation from another entity or operation, and do not necessarily require or imply one of these entities or operations. There is any such actual relationship or order between. Moreover, the terms "comprise" or any other variants thereof are intended to cover non-exclusive inclusion, so that a process, method, article or device including a series of elements not only includes those elements, but also includes those that are not explicitly listed other elements of, or also include elements inherent to this process, method, article or equipment.

Although the embodiments of the present utility model have been shown and described, for those skilled in the art, it will be understood that various changes, modifications and replacements can be made to these embodiments without departing from the principle and spirit of the present utility model, the scope of the present utility model is defined by the appended claims and their equivalents.

The invention claimed is:

1. A gas idling transition passage structure for oil and gas dual-purpose carburetor comprises a carburetor body 1 and a mixing chamber 4;

a choke valve 5 and a throttle valve 9 disposed in the mixing chamber 4 in the order of the air flow direction;

a gas intake pipe 2 for supplying gas to the mixing chamber 4 disposed on the carburetor body 1;

a first air inlet pipe 7 and a second air inlet pipe 8 disposed in the carburetor body 1 in parallel;

when in use, an opening of an outlet end of the second air inlet pipe 8 is located in the mixing chamber 4 and the position of the outlet end of the second air inlet pipe 8 is at the intersection of an outer circle and the mixing chamber 4 when the throttle valve 9 is closed;

an outlet opening of the first air inlet pipe 7 located in front of the second air inlet pipe 8 in the mixing chamber 4;

the first air inlet pipe 7 and the second air inlet pipe 8 communicated with the gas intake pipe 2 through a bypass passage 3.

2. The gas idling transition passage structure for oil and gas dual-purpose carburetor as defined in claim 1, wherein a distribution chamber 6 is disposed between the bypass passage 3 and the first air inlet pipe 7 and the second air inlet pipe 8.

* * * * *